US007478543B2

(12) United States Patent
Butler

(10) Patent No.: US 7,478,543 B2
(45) Date of Patent: Jan. 20, 2009

(54) JEWELRY ITEM WITH A NOVEL SETTING FOR PRECIOUS STONES

(75) Inventor: Jerome D. Butler, Great Neck, NY (US)

(73) Assignee: Alfred Butler, Inc., New York, NY (US)

( * ) Notice: Subject to any disclaimer, the term of this patent is extended or adjusted under 35 U.S.C. 154(b) by 154 days.

(21) Appl. No.: 11/593,145

(22) Filed: Nov. 3, 2006

(65) Prior Publication Data

US 2008/0104995 A1 May 8, 2008

(51) Int. Cl.
*A44C 17/02* (2006.01)

(52) U.S. Cl. ..... 63/28; D11/34

(58) Field of Classification Search ..... None
See application file for complete search history.

(56) References Cited

U.S. PATENT DOCUMENTS

D490,338 S * 5/2004 Hurwitz ..... D11/34

* cited by examiner

*Primary Examiner*—Jack W. Lavinder
(74) *Attorney, Agent, or Firm*—Gottlieb, Rackman & Reisman

(57) ABSTRACT

A ring or other similar jewelry item includes a base, a plurality of platforms arranged on the base and a plurality of prongs, each prong being disposed on a platform. The prongs extend above the platforms and are arranged to form settings for precious or semi-precious stones.

26 Claims, 3 Drawing Sheets

FIG. 6
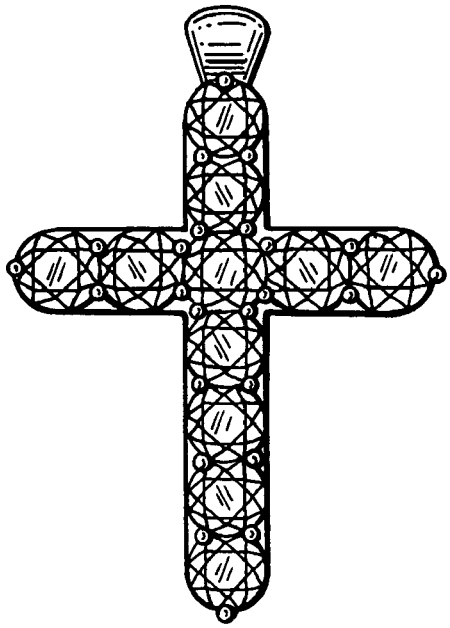
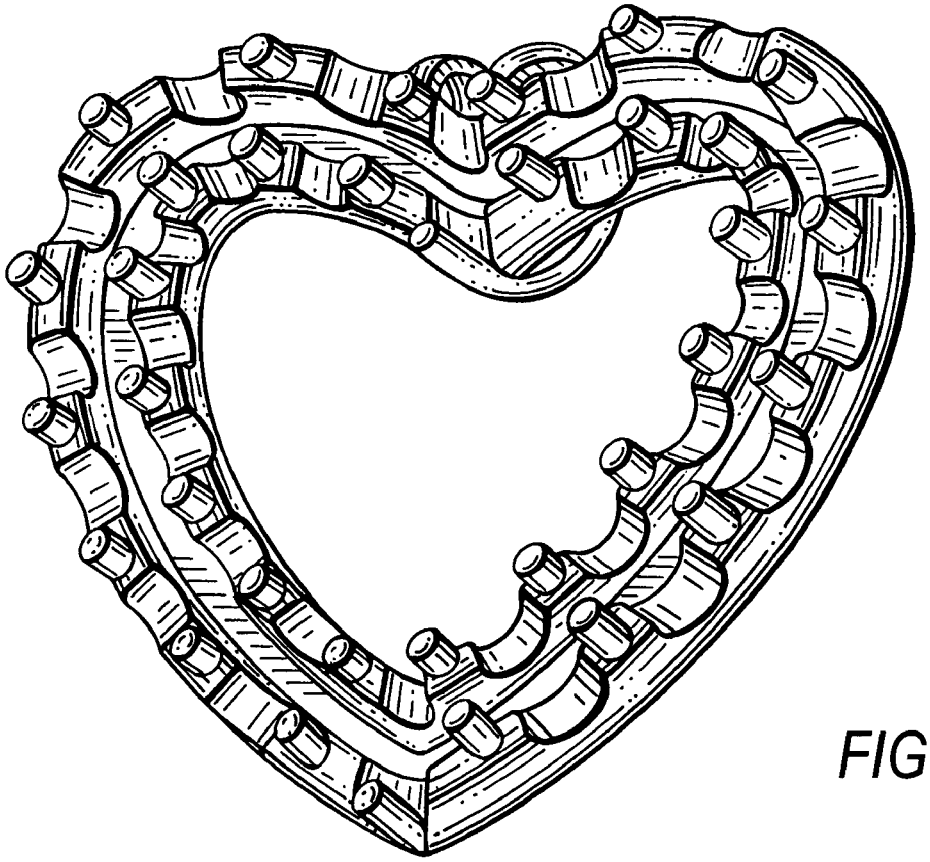
FIG. 7

JEWELRY ITEM WITH A NOVEL SETTING FOR PRECIOUS STONES

BACKGROUND OF THE INVENTION

A. Field of Invention

This invention pertains to a novel setting for diamonds and other precious stones, and, more particular, to a novel setting used in a jewelry item that raises the stones to a higher position then previous arrangements. The settings can be used in rings, pendants, earrings and other jewelry items.

B. Description of the Prior Art

Many types of jewelry items incorporate precious stones. In most instances, these stones are mounted on the item by settings consisting of several prongs disposed peripherally about the stones. It has been found that it is desirable to use settings that raise the stones because they draw more attention to the stones, provide an illusion of bigger stones and allow for more light to shine through the stones, thereby making them more attractive.

One such type of setting is the tall prong setting in which the prongs are longer than in a standard setting to lift the stone into the air, above the rest of the jewelry item. This setting is more suitable for items with individual stones and is not advisable to be worn during sports or other strenuous activity during which the stone can be hit and dislodged.

Another setting is of the type used on eternity rings. These rings are formed with cavities in the shank of the rings and prongs attached to the shank and disposed to position the stones over the cavities. A problem with this construction is that the resulting jewelry item looks heavy, the appearance of the ring is dominated by the metal portion of the ring and the stone is overshadowed. A further problem is that the cavities themselves collect dirt which reduces the amount of light reflected into the stones.

SUMMARY OF THE INVENTION

Briefly, a jewelry item constructed in accordance with this invention includes a base with a plurality of platforms arranged in pairs and extending to form setting supports for precious stones. A prong is mounted on each platform and arranged to cooperate with other prongs to form settings for the stones. The prongs are recessed from the edges of the platform. As a result, the item has a clean, airy look with much less metal in evidence then the standard eternity-type settings. Moreover, the stones are thrust upward toward the viewer, thereby emphasizing the stones and de-emphasizing the rest of the item. The invention is applicable to a ring, an earring, a pendant, a broche, etc.

DETAILED DESCRIPTION OF THE INVENTION

FIG. 6 shows a top view of a pendant, such as a cross constructed in accordance with this invention; and FIG. 7 shows an orthogonal view of a heart-shaped pendant.

DETAILED DESCRIPTION OF THE INVENTION

Figure 1:
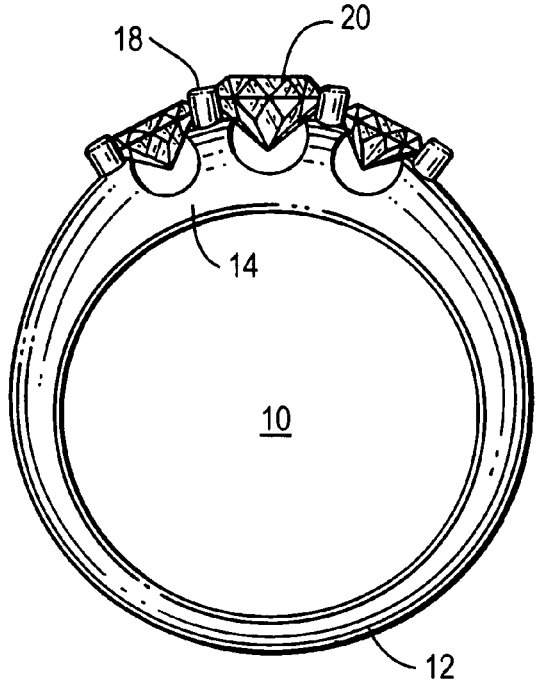
FIG. 1 shows a side elevational view of a ring constructed in accordance with the invention.

FIGS. 1-5 show how the present invention is implemented to make a ring. More specifically, a ring 10 includes a toroidal shank 12. One section of the shank 12 has a greater thickness in order to define a crown portion 14. Rising radially outwardly from the shank 12 in the area of crown 14 are provided a series of spaced side-by-side platforms 16 with extending prongs 18. Prongs 18 hold stones 20 in a conventional manner well known in the art. (In FIGS. 2-5 the ring 10 is shown without the stones 20 for the sake of clarity).

In addition, two prongs 19 are disposed on the outer surface 22 of the shank 12. As seen more clearly in FIG. 3, platforms 16 are formed by drilling holes transversally through the crown 14 to form cavities 24. Each cavity 24 has a sidewall 26 that is partially cylindrical extending from a center O and having a radius R. Moreover, each sidewall 26 extends over an arc of over 180 degrees. As a result, each of the platforms 16 has somewhat of an hourglass shape with an enlarged top surface 30. Moreover, each platform has sidewalls 32 that are essentially coplanar with the rest of the crown 14. Prongs 18 are disposed inwardly of and offset from the edges of the platforms and their sidewalls 32.

Figure 2:
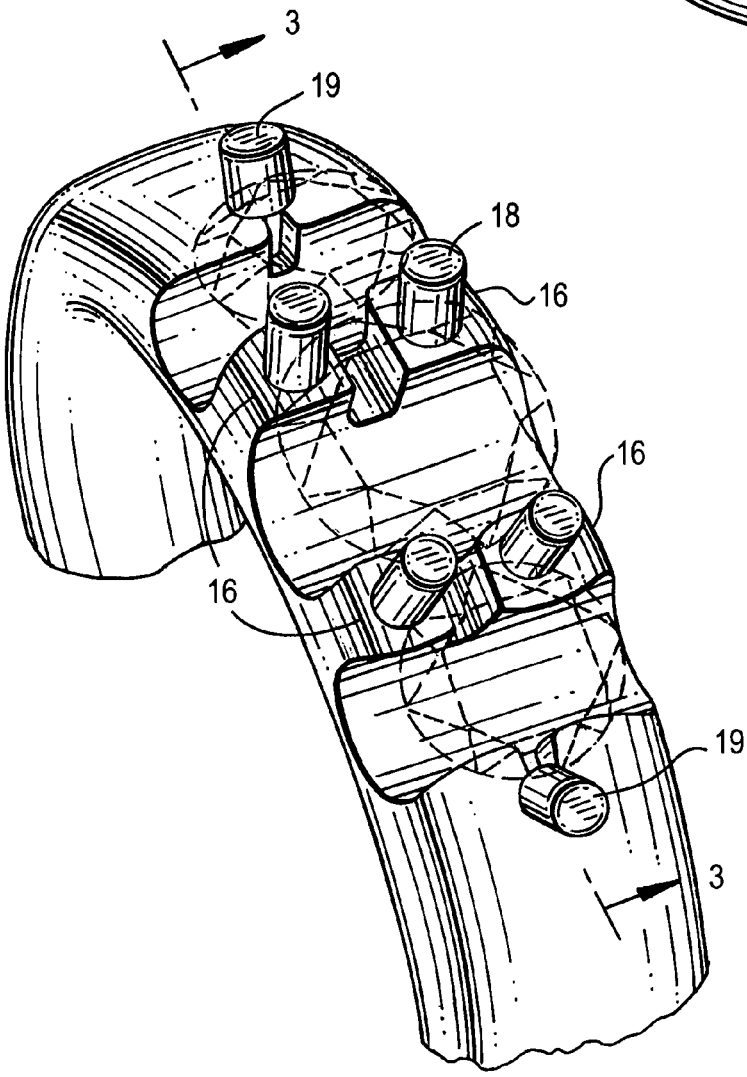
FIG. 2 shows a partial perspective view of the ring of FIG. 1.

The ring 10 further includes longitudinal channels 34. Each channel 34 is disposed between two side-by-side platforms 16. The prongs 18 are sized and shaped to secure stones 20, as shown in FIGS. 1 and 2. During the installation of the stones 20, the prongs 18 can be notched if necessary.

As discussed above, the resulting ring 10 has several advantageous features and characteristics. The cavities 24 and channels 34 reflect light into the stones 20 which makes them shine more prominently and therefore they look bigger, brighter and more expensive. The channels 34 facilitate fluid flow under and between the stones 20 during cleaning, thereby insuring that the dirt between the prongs is removed effectively. The platforms 16 have more substance, are thicker and therefore provide more mechanical support for the prongs 18. Moreover, the resulting settings provide a more open and less metallic look than the prior art.

Figure 3:
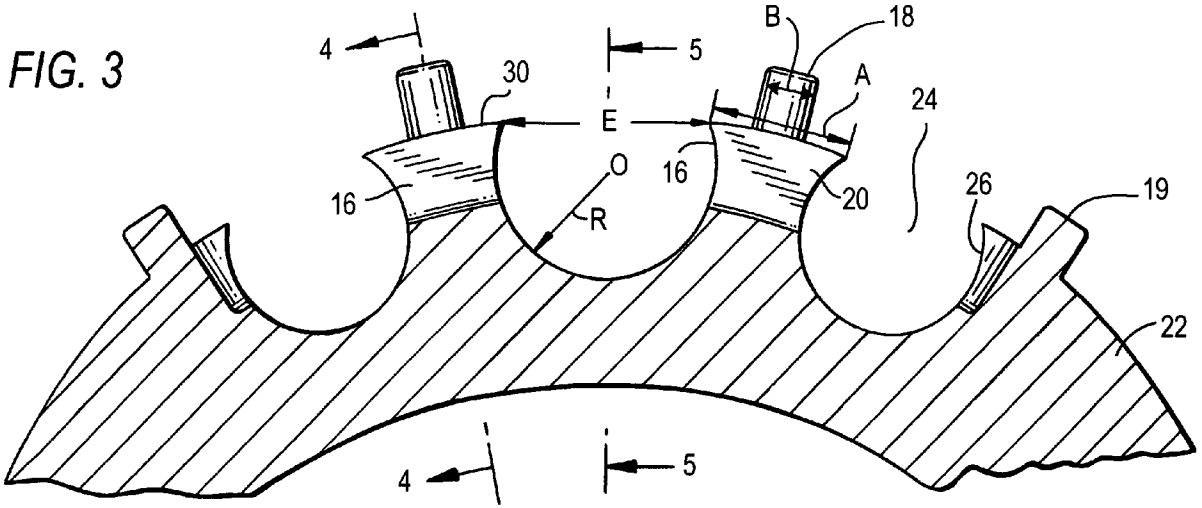
FIG. 3 shows a partial side cross-sectional view of the ring of FIG. 1.

In particular, the ratio of the longitudinal width A along the top surfaces of platform 16 to the longitudinal thickness B of prong 18 is between about 2:1 and 5:1 (see FIG. 3).

Figure 5:
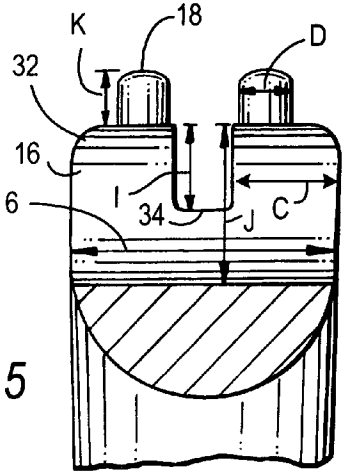
FIG. 5 shows a partial cross-sectional view taken along lines 5-5 in FIG. 3.

The ratio of the transverse width C of platform 16 to the transverse thickness D of prong 18 is between about 1.5:1 and 4:1 (see FIG. 5).

The ratio of the longitudinal distance E 16 across cavity 24 and the longitudinal width A of each platform 16 is between about 1:1 and 3:1 (see FIG. 3).

Figure 4:
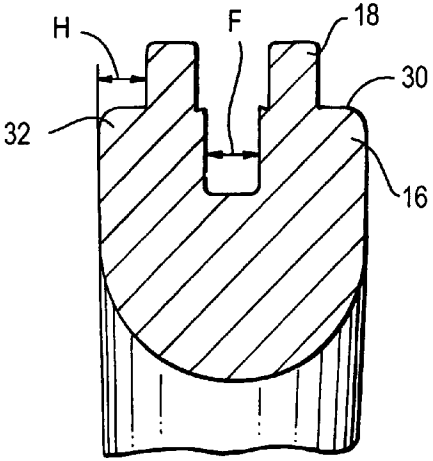
FIG. 4 shows a partial cross-sectional view taken along lines 4-4 in FIG. 3.

The ratio of the transverse width C of platform 16 to the transverse width F of channel 34 is between about 1:1 and 4:1 (see FIGS. 4 and 5).

The ratio of the transverse width G of shank crown portion 14 and the transverse width C of each side-by-side platform is between about 9:4 and 3:1 (see FIG. 5).

The ratio of the transverse width of G of shank crown portion 14 and the distance H that prong 18 is disposed inwardly of side-wall 32 is between about 5:1 and 10:1 (see FIGS. 4 and 5).

The ratio of the transverse width C of platform 16 and the distance H which prong 18 is disposed inwardly of side-wall 32 is between about 1.5:1 and 4:1. (see FIGS. 4 and 5).

The ratio of the depth J of cavity 24 to the depth I of channel 34 is between about 1.5:1 and 3:1 (see FIG. 5).

The ratio of the depth I of cavity 24 and the height K of prong 18 is between about 1:1 and 3:1 (see FIG. 5).

The present invention was described in conjunction with a ring 10. However, it can be extended to other jewelry items. FIG. 6 shows a pendant such as a cross 40 incorporating the invention claimed herein. For this item, the base is a flat cross. FIG. 7 shows a heart-shaped pendant.

Obviously numerous modifications may be made to this invention without departing from its scope as defined in the appended claims.

The invention claimed is:

1. A jewelry item comprising:

a base;

a plurality of platforms arranged on said base in side-by-side pairs;

a plurality of prongs with at least some of said prongs being disposed on said platforms and constructed and arranged to secure one or more precious stones; and channels, each channel running longitudinally between each platform of each said platform pairs.

2. The item of claim 1 wherein said platforms are integrally formed with said base.

3. The item of claim 1 wherein said plurality of platform pairs are separated by extending cavities.

4. The jewelry item of claim 3, wherein each platform has a top surface and wherein said plurality of platform pairs are separated by said cavities a distance at least the same as the width of said platform top surface.

5. The jewelry item of claim 3, wherein each said cavity has a depth greater than the height of any of said disposed prongs.

6. The item of claim 1 wherein each platform has a top surface with one prong being mounted on said top surface.

7. The item of claim 6 wherein each platform has a sidewall and said one prong is disposed inwardly from said sidewall.

8. The jewelry item of claim 6, wherein each said platform top surface has a width dimension that is greater than the thickness dimension of said prong mounted on said platform surface.

9. The item of claim 1 wherein said base is toroidal shaped to form a ring.

10. The item of claim 1 wherein said base is flat to form a pendant or a pin.

11. The jewelry item of claim 1, wherein each said platform has a top surface with a width dimension that is at least the same as the width dimension of said channel.

12. The jewelry item of claim 1, wherein each said cavity has a depth which is greater than the depth of any of said channel.

13. A jewelry item comprising:

a base;

a plurality of platforms attached in a predetermined pattern along said base; and a plurality of prongs disposed on respective platforms and being arranged to form settings for precious stones, said prongs being distinct from said platforms;

wherein said platforms are separated by cavities extending transversally between pairs of said platforms; and wherein said cavities have sidewalls, said sidewalls having a partially cylindrical shape.

14. The item of claim 13, further comprising channels extending between two of said cavities and separating the platforms of each respective pair.

15. The item of claim 14, wherein said channels have a depth that is less then the depth of said cavities.

16. The item of claim 13, wherein said prongs are arranged to form said setting in shared-prong configuration.

17. The item of claim 13, wherein said prongs are rod-shaped.

18. The item of claim 13, wherein each platform includes a platform sidewall and wherein each prong is recessed transversally from said sidewall.

19. The item of claim 13, wherein each platform has a generally hourglass-shaped profile.

20. The item of claim 13, wherein said item is a ring.

21. The item of claim 13, wherein said item is a pendant.

22. The item of claim 13, wherein said item is a broche.

23. The item of claim 13 further comprising additional prongs not mounted on said platforms.

24. A jewelry item comprising:

a base;

a plurality of platforms attached in a predetermined pattern along said base;

a plurality of prongs disposed on respective platforms and being arranged to form settings for precious stones, said prongs being distinct from said platforms; AND channels extending between two of said cavities and separating the platforms of each respective pair.

25. A jewelry item comprising:

a base;

a plurality of platforms attached in a predetermined pattern along said base; and a plurality of prongs disposed on respective platforms and being arranged to form settings for precious stones, said prongs being distinct from said platforms;

wherein said prongs are arranged to form said setting in shared-prong configuration.

26. A jewelry item comprising:

a base;

a plurality of platforms attached in a predetermined pattern along said base;

a plurality of prongs disposed on respective platforms and being arranged to form settings for precious stones, said prongs being distinct from said platforms; and additional prongs not mounted on said platforms.

* * * * *